US011332224B2

(12) United States Patent
Kim

(10) Patent No.: US 11,332,224 B2
(45) Date of Patent: May 17, 2022

(54) AUTOMATIC WATER-FLOWING-DIRECTION-ALIGNMENT SYSTEM

(71) Applicant: Chong Hun Kim, Fountain Valley, CA (US)

(72) Inventor: Chong Hun Kim, Fountain Valley, CA (US)

(73) Assignee: Chong Hun Kim, Fountain Valley, CA (US)

( * ) Notice: Subject to any disclaimer, the term of this patent is extended or adjusted under 35 U.S.C. 154(b) by 0 days.

(21) Appl. No.: 16/802,453

(22) Filed: Feb. 26, 2020

(65) Prior Publication Data

US 2021/0261224 A1 Aug. 26, 2021

(51) Int. Cl.
*B63B 35/44* (2006.01)

(52) U.S. Cl.
CPC ..... *B63B 35/44* (2013.01)

(58) Field of Classification Search
CPC ..... F03B 17/062; B63B 35/44
See application file for complete search history.

(56) References Cited

U.S. PATENT DOCUMENTS

2006/0280605 A1* 12/2006 Budi ..... F03B 17/065 416/84
2014/0219800 A1* 8/2014 Lee ..... F03D 3/067 416/86

* cited by examiner

*Primary Examiner* — Anthony D Wiest

(57) ABSTRACT

An automatic-direction-alignment-system aligns a floating platform axial-centerline with the water-flowing-direction automatically. This system maneuvers the floating platform to let the center-line of the floating platform to be aligned with the ocean-wave-flowing-direction automatically in the ocean where the ocean-wave-flowing-direction keeps changing.

2 Claims, 12 Drawing Sheets

DFP Center Line Alignment with Wave Direction

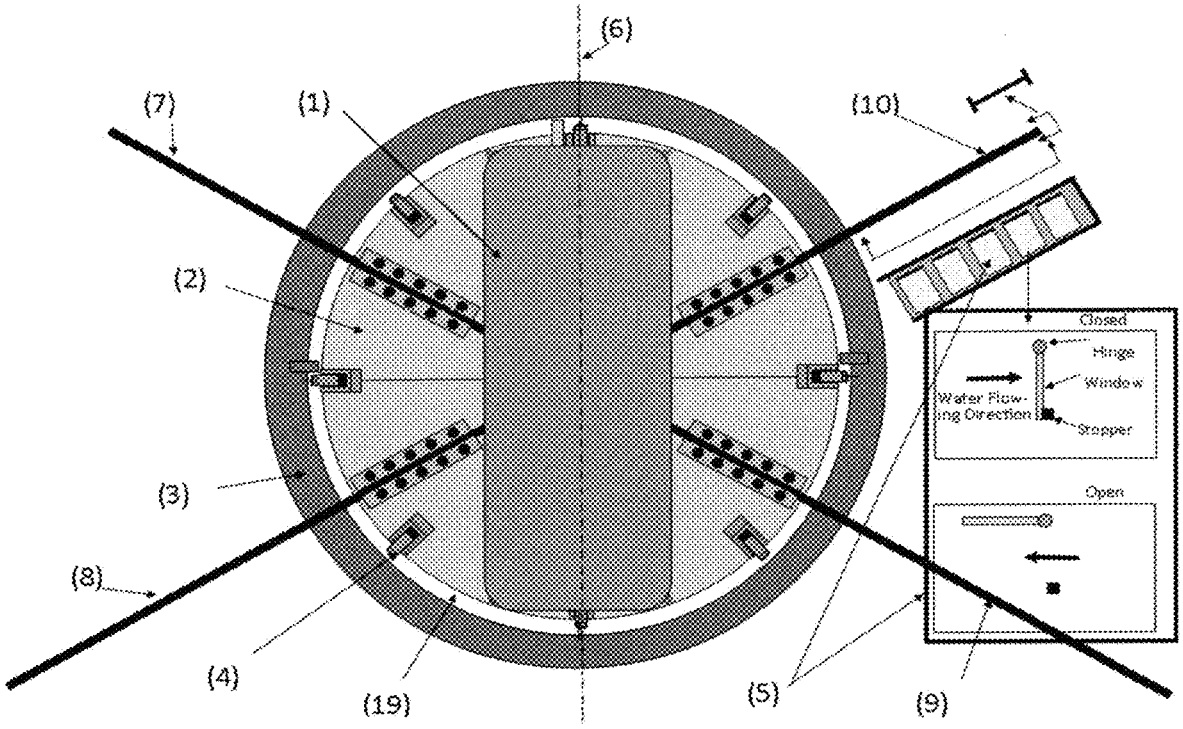
Fig. 1 Top View of the DFP

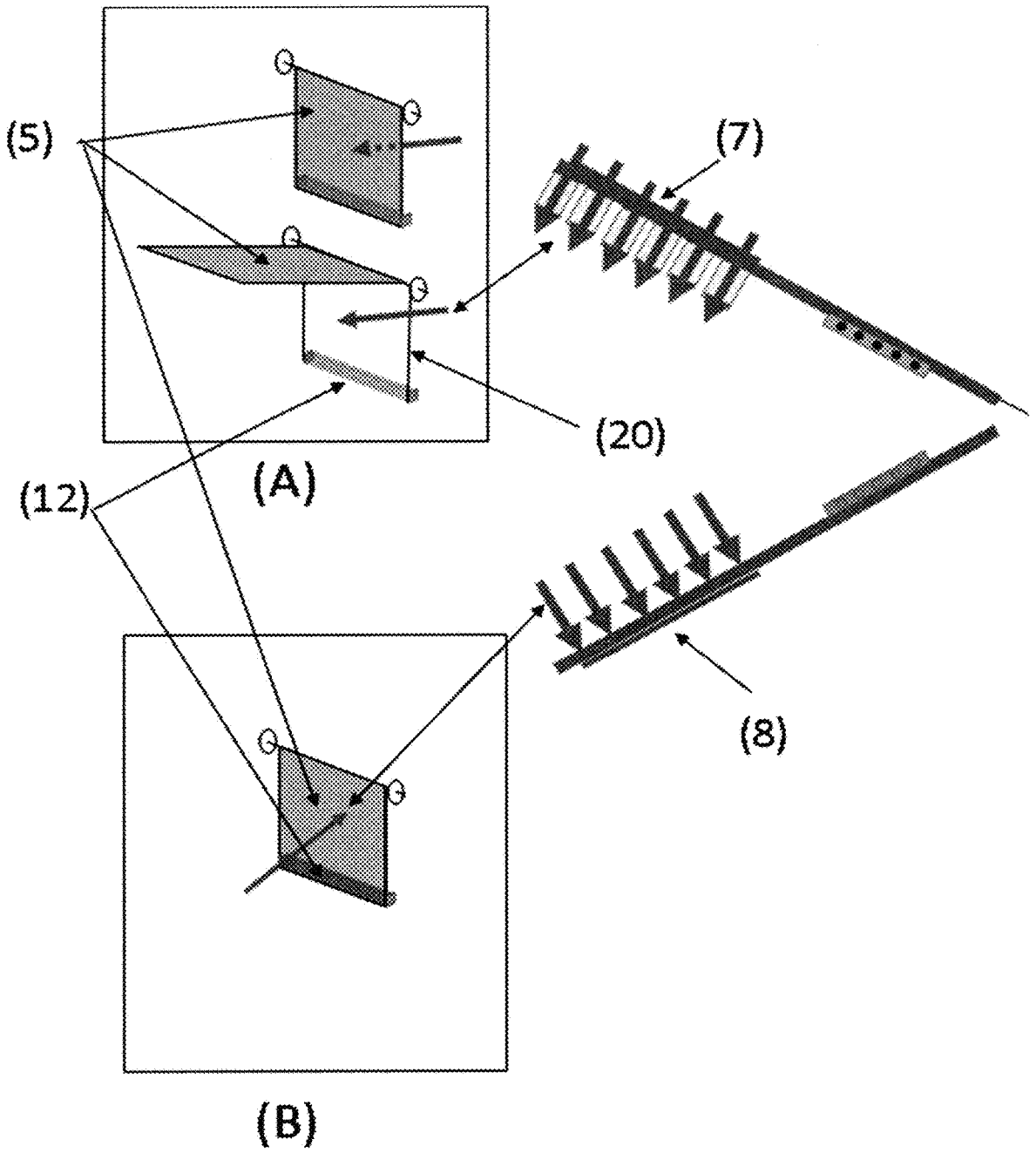
Fig. 2 Water Mass Passing or Blocking Window

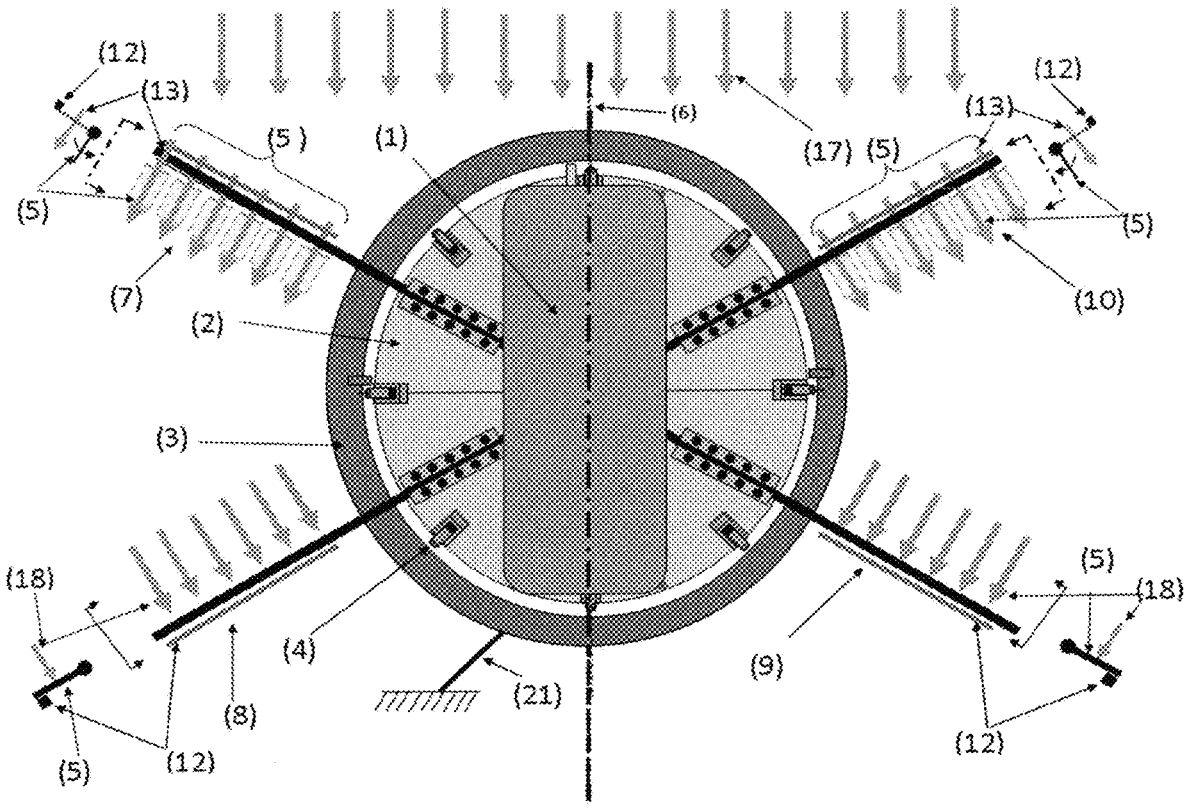
Fig. 3 DFP Center Line Alignment with Wave Direction

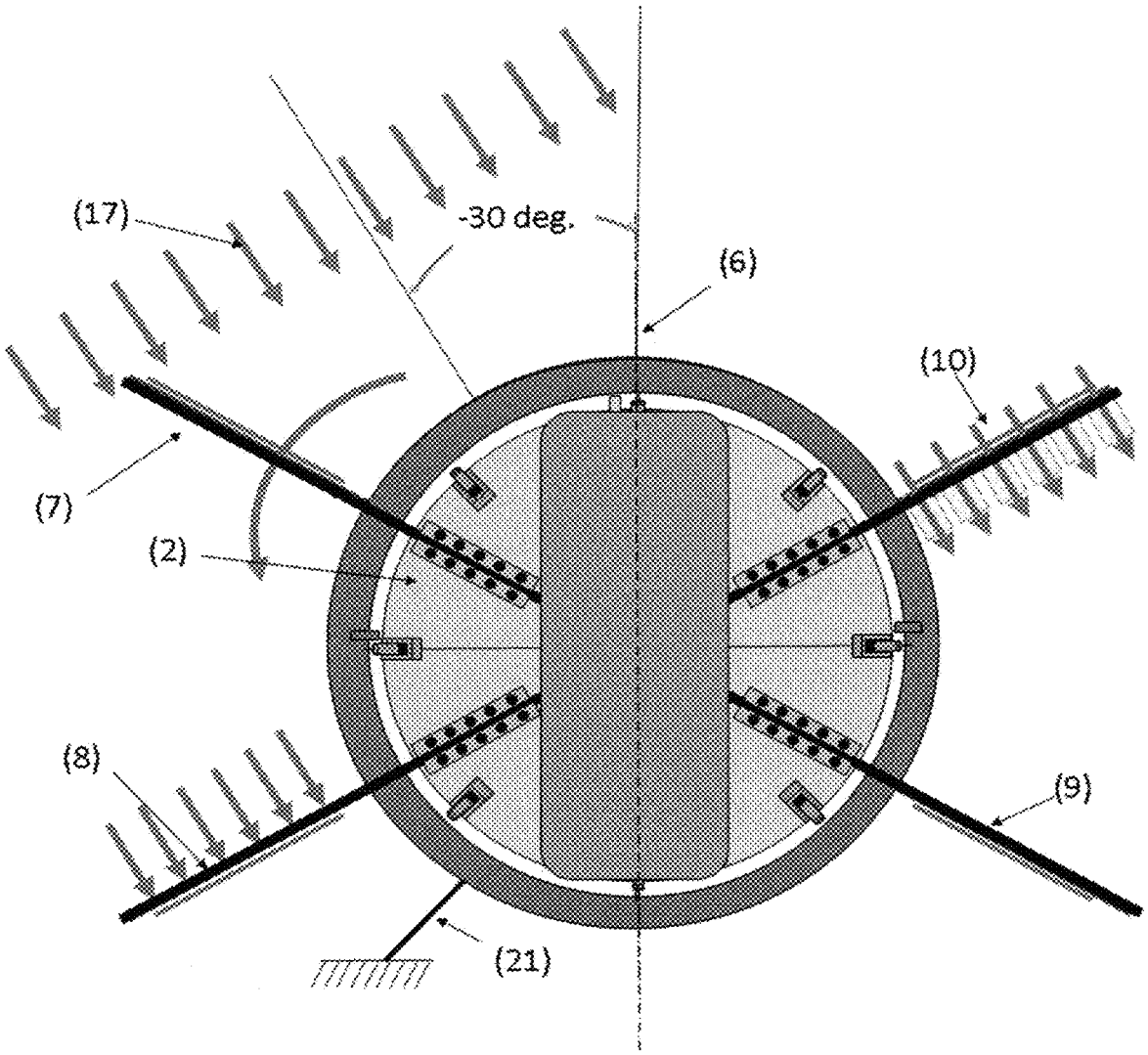
Fig. 4 Beginning of 30-degree counterclockwise rotation

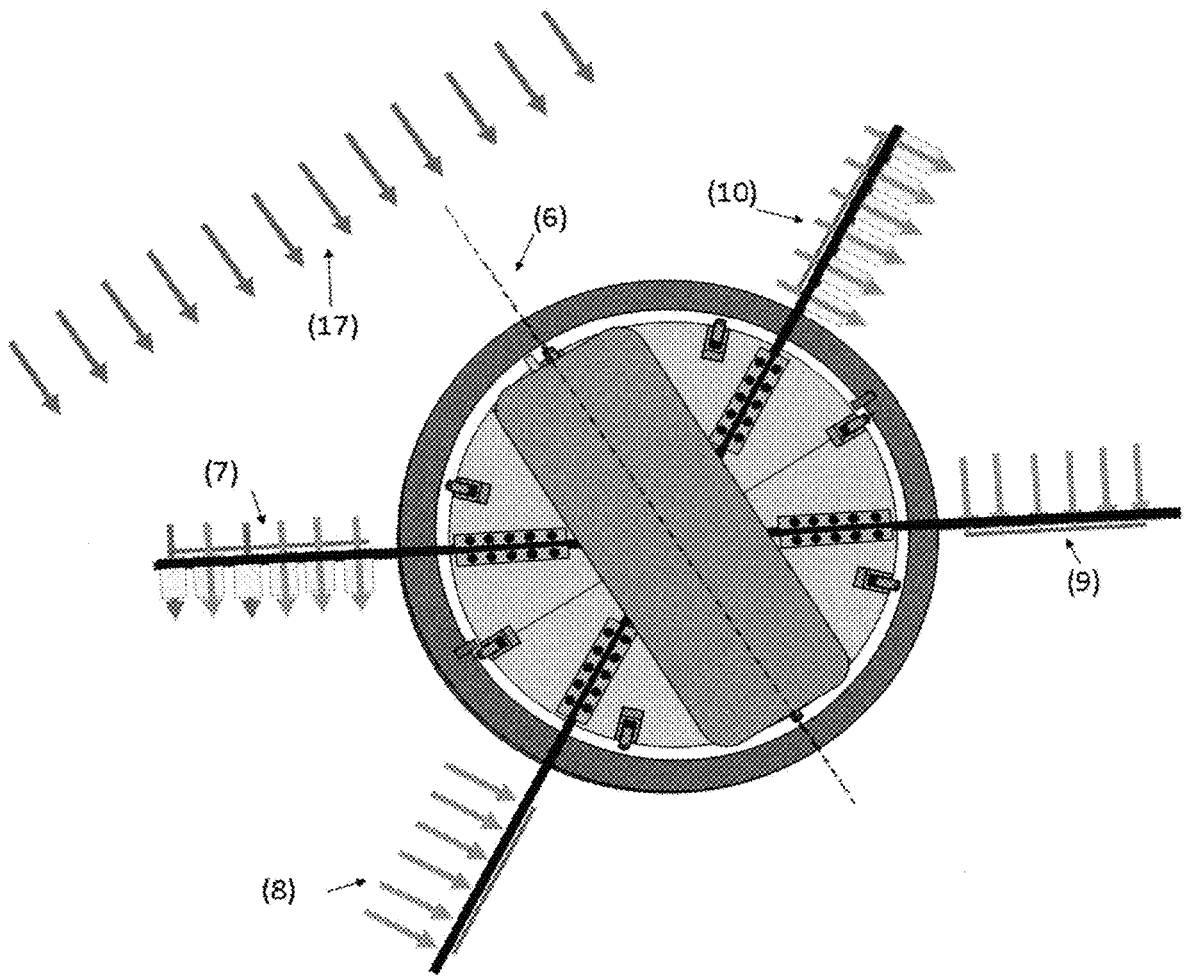
Fig. 5 After the 30-degree counterclockwise rotation

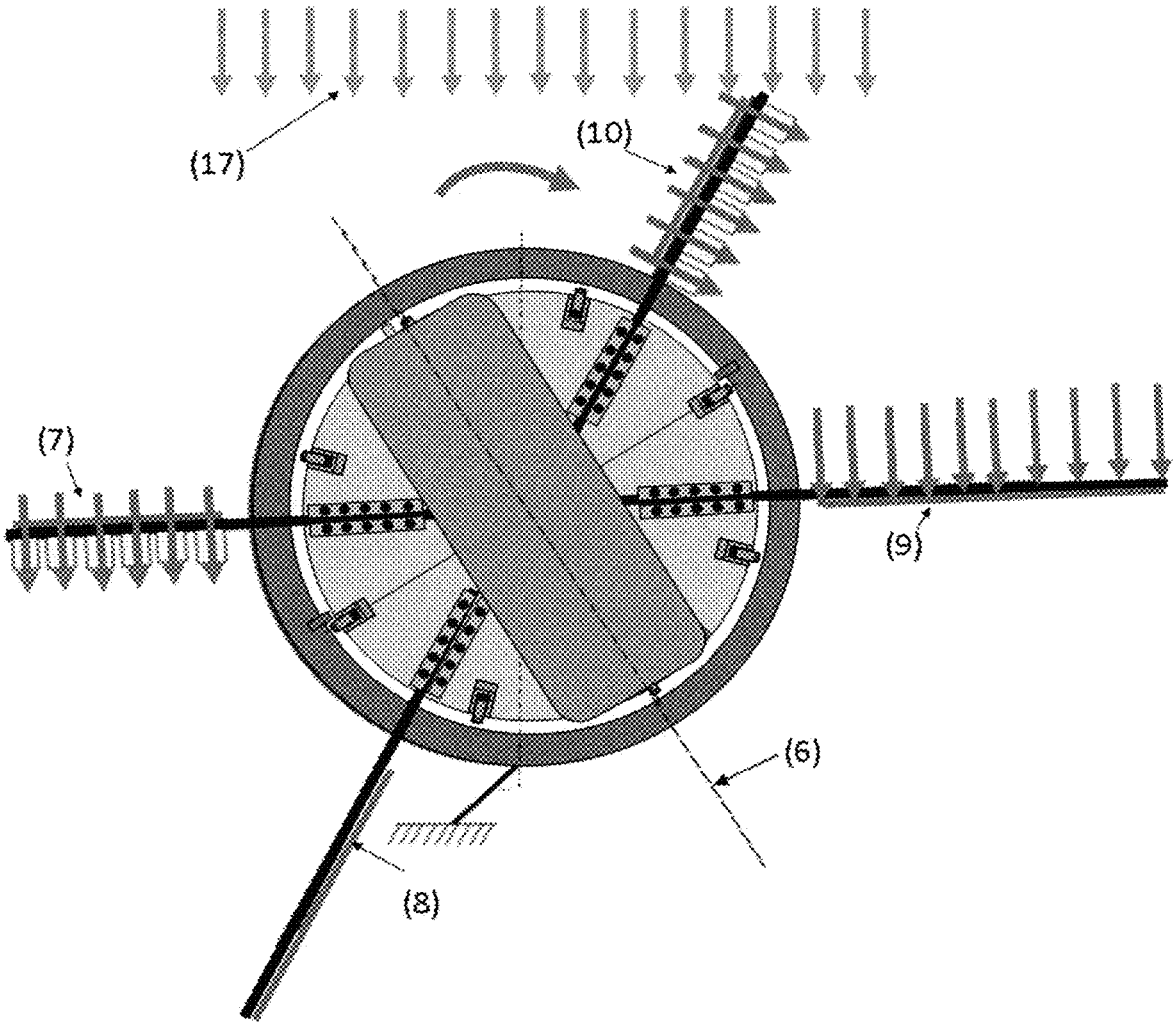
Fig. 6 30-degree clockwise rotation

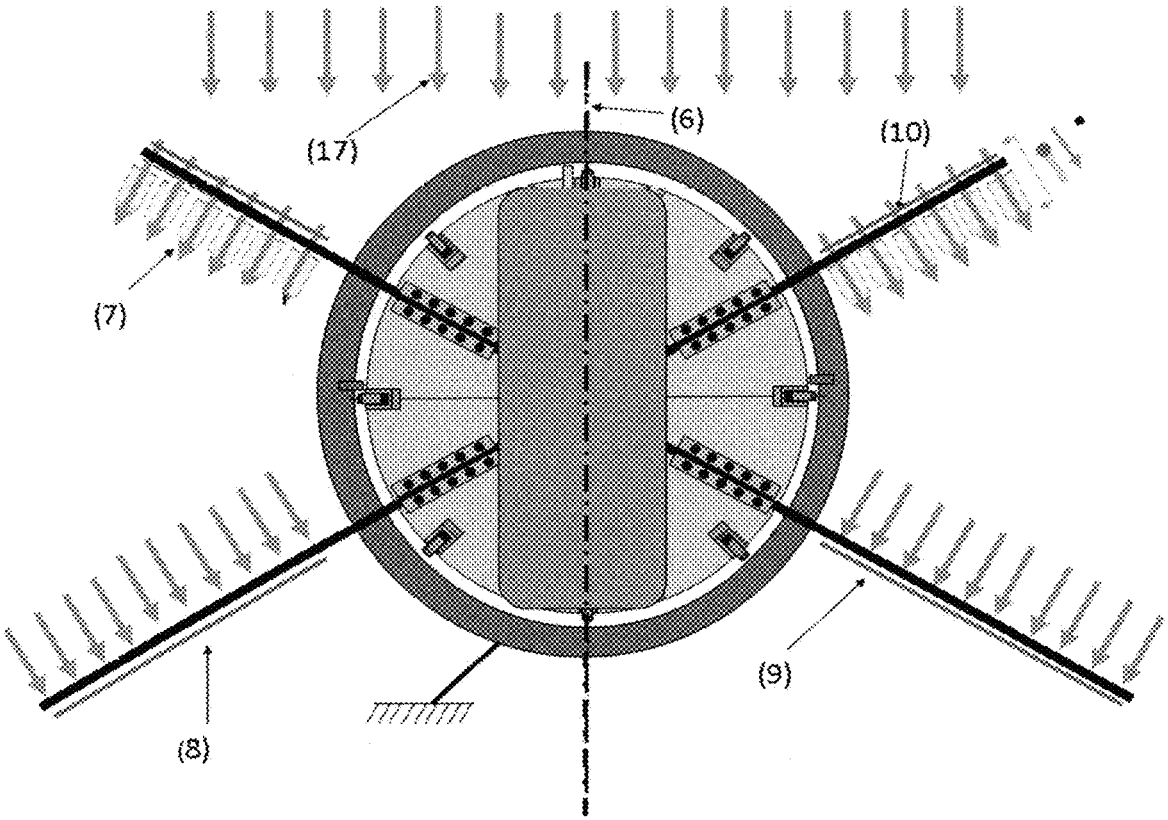
Fig. 7 After the 30-degree clockwise rotation back to the original position

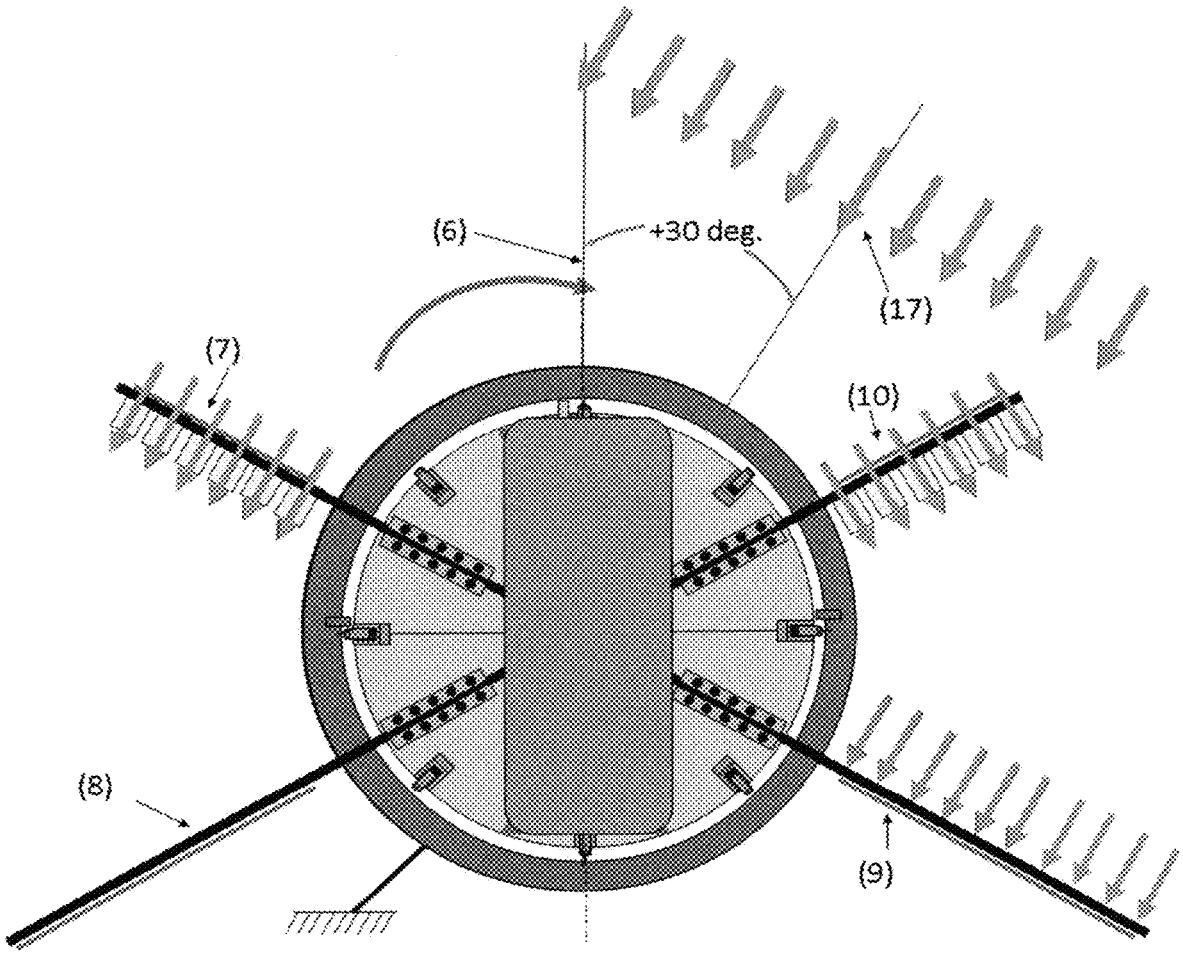
Fig. 8 30-degree clockwise rotation of the Direction of the Water Mass Flow

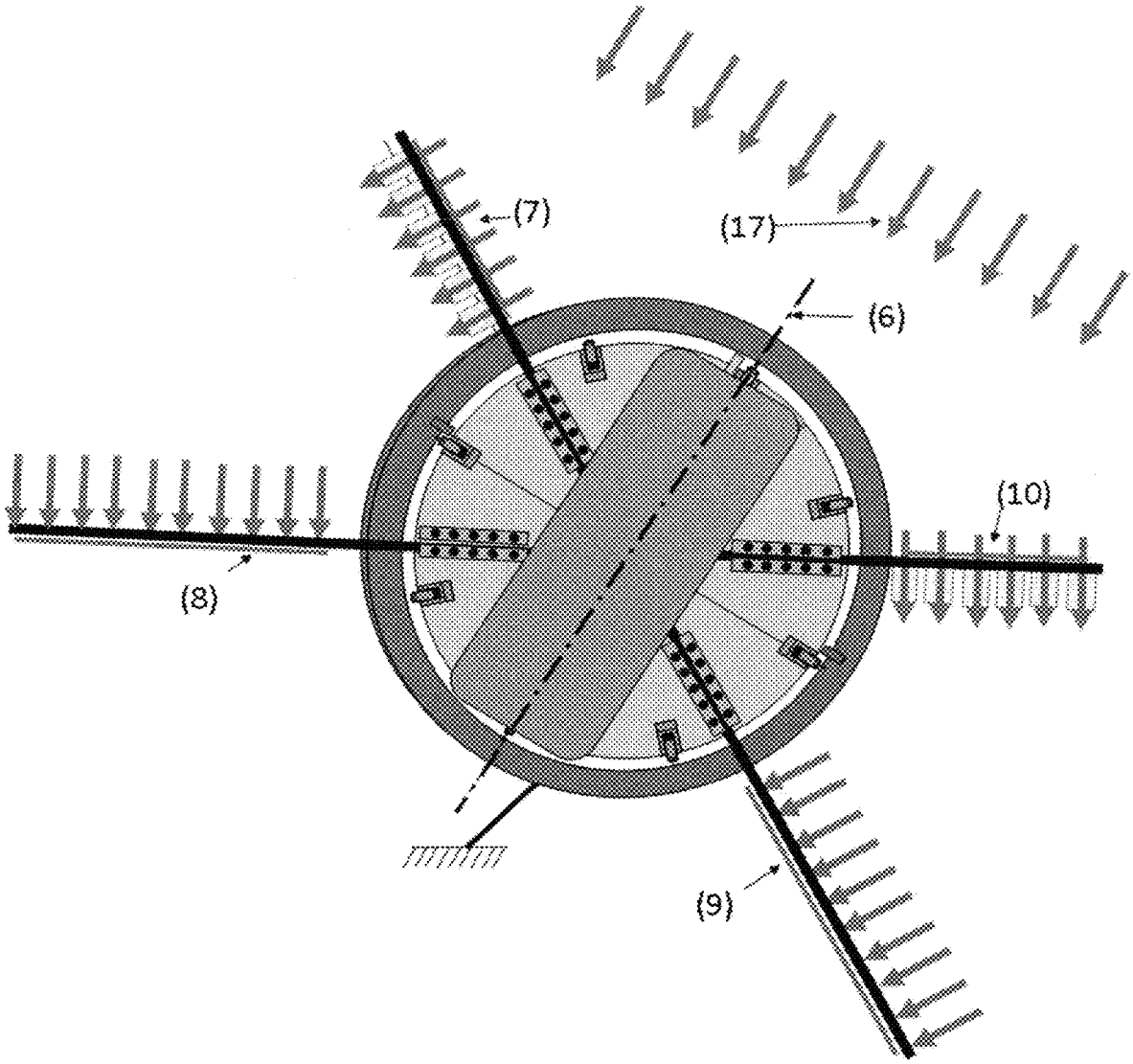
Fig. 9 After the 30-degree clockwise rotation

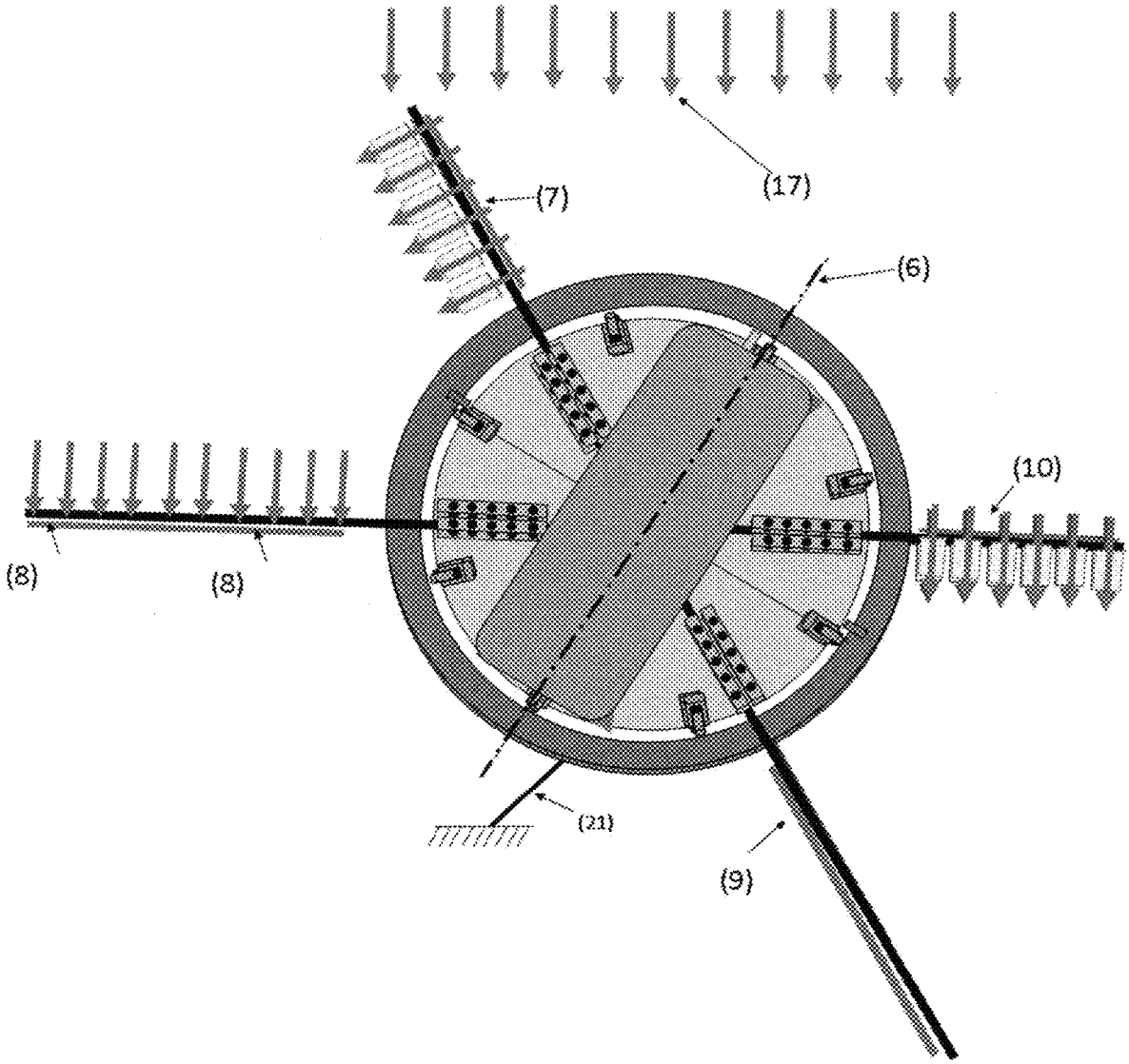
Fig. 10 30-degree counterclockwise rotation of the Direction of the Water Mass Flow back to the original direction

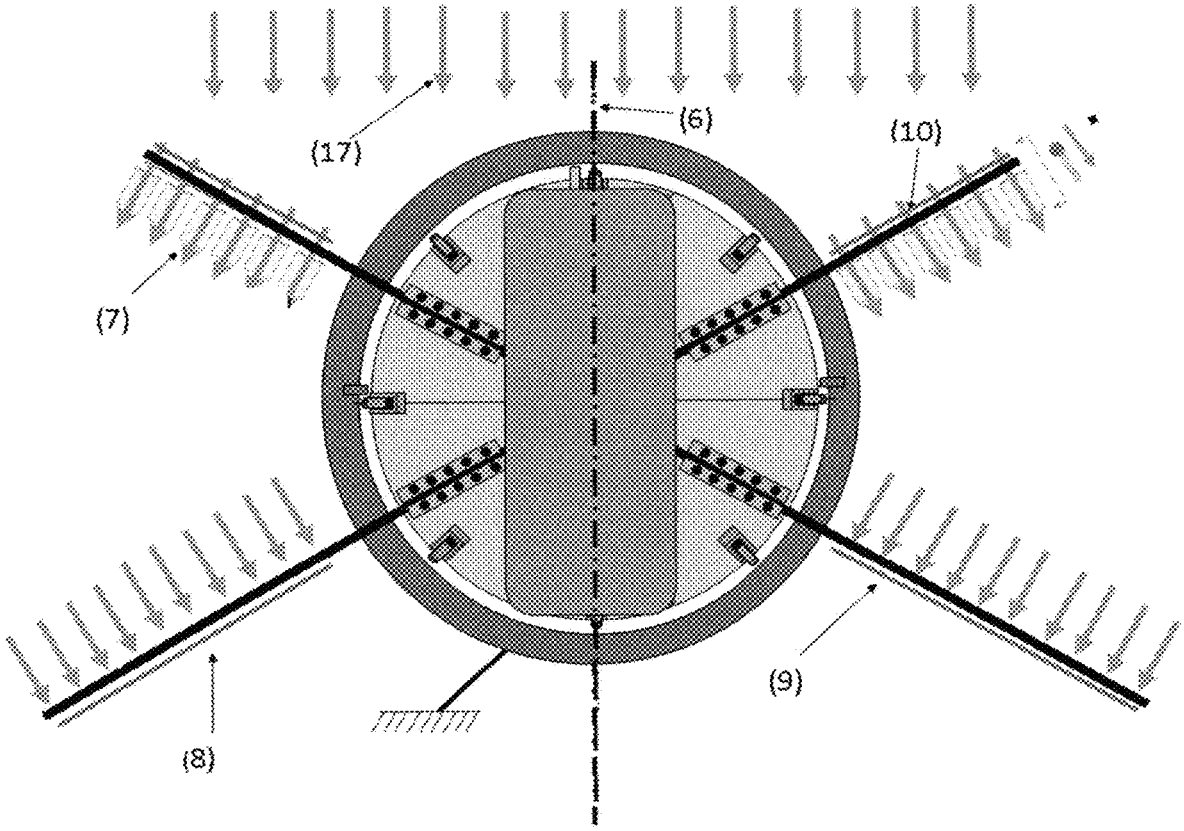
Fig. 11 After the 30-degree counterclockwise rotation

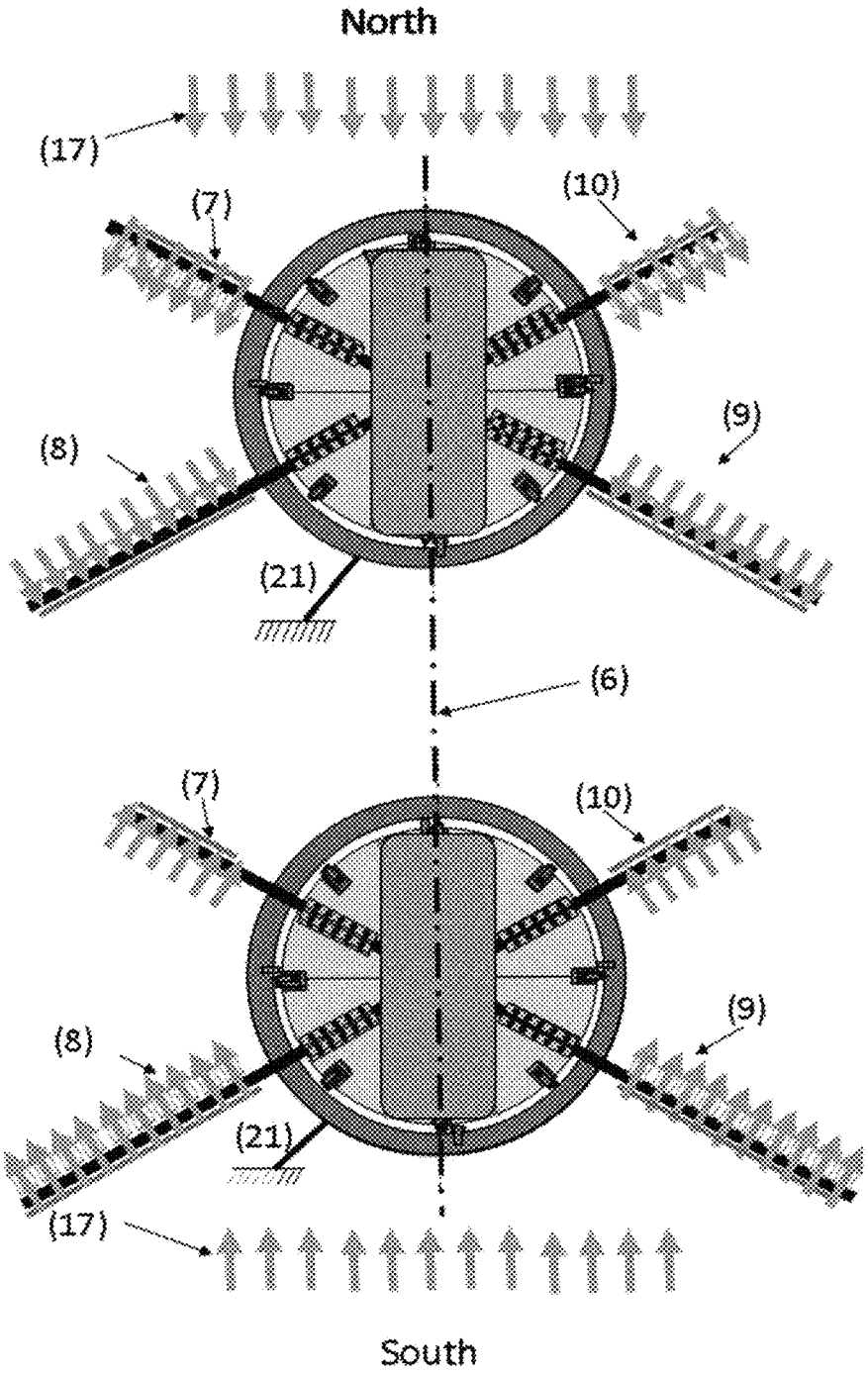
Fig. 12 Automatic Direction Alignment System in the ocean

AUTOMATIC WATER-FLOWING-DIRECTION-ALIGNMENT SYSTEM

CROSS-REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

(1) Field of the Invention

This mechanical system involves aligning a Floating Platform Axial Center Line (FPACL) with the water flowing direction automatically. It maneuvers the floating platform to let the FPACL to be aligned with the wave flowing direction automatically when the wave direction constantly changes in the ocean.

(2) Description of Related Art Including Information Disclosed Under 37 CFR 1.97 and 1.98

Not Applicable

BRIEF SUMMARY OF THE INVENTION

In the ocean, the direction of the water mass flow is changing all the time. It is desired that the FPACL aligns with the direction of the water mass flow consistently as the flow direction changes. The maneuvering system consists of four wings and each wing has many window frames that have windows that can open in one direction. That is, if the water flows in one direction, then the windows will be opened by the push of the water mass flow. But, if water flows in the opposite direction, the windows are not allowed to be opened.

The four wings are installed symmetrically with respect to the axial centerline. If the water mass flows in one direction, then the windows in the front two wings will be opened and the windows in the two rear wings will be closed and evenly distributed water pressure on the set of the two rear wings balances the Floating Platform (FP) with respect to the water flowing direction and aligns the FPACL with the direction in which the water mass flows.

If the water flowing direction changes, the set of four wings generates a torque that rotates the FPACL until the FPACL is aligned with the direction in which the water mass flows.

BRIEF DESCRIPTION OF THE SEVERAL VIEWS OF THE DRAWINGS

FIG. 1 shows a top view of the Directional Floating Platform (DFP) configuration.

FIG. 2. Water Mass Passing or Blocking Window

FIG. 3. Shows the Directional Floating Platform (DFP) Center Line Alignment with Wave Direction.

FIG. 4. Beginning of 30-degree counterclockwise rotation

FIG. 5. After the 30-degree counterclockwise rotation

FIG. 6. 30-degree clockwise rotation

FIG. 7. After the 30-degree clockwise rotation back to the original position FIG. 8. 30-degree clockwise rotation of the Direction of the Water Mass Flow FIG. 9. After the 30-degree clockwise rotation FIG. 10. 30-degree counterclockwise rotation of the Direction of the Water Mass Flow back to the original direction FIG. 11. After the 30-degree counterclockwise rotation FIG. 12. Automatic Direction Alignment System in the ocean

DETAILED DESCRIPTION OF THE INVENTION

FIG. 1 shows a top view of DFP (Directional Floating Platform). The FP (Floating Platform) (1) is placed on the top of the FP Air/Water Tank (2). The FP (1) is attached to the FP Air/Water Tank (2) and they rotate together. The FP Air/Water Tank (2) will be filled with the right amount of air and water to hold its vertical position for easy yaw maneuver, and it will be installed inside the System Air/Water Tank (3). There are four wings: Wing A (7), Wing B (8), Wing C (9), and Wing D (10). These wings are attached to the FP Air/Water Tank (2) only. These Wings are not attached to the System Air/Water Tank (3) Each wing has many windows (5). Yaw maneuver supporting rollers (4) are installed for easy yaw maneuver of the FP (1). The FP (1) center line (6) is shown in the figure. The space (19) between the FP Air/Water Tank (2) and the System Air/Water Tank (3) is filled with sea water.

FIG. 2 explains how the windows (5) are opened and closed:

(A) in FIG. 2 shows that window stopper (12) is installed at the bottom of the window frame (20) such a way that when the water mass flows in the direction shown in the figure, the window stopper (12) cannot stop the rotation of window (5) and consequently the windows (5) cannot block the water mass flow and let the water mass pass through, as shown in the figure.

(B) in FIG. 2 shows that as the water mass flows in the direction as shown in the figure, the window stopper (12) stops the window rotation and thus blocks the flow of the water mass. Consequently, the water pressure builds up on the window.

The next 10 figures explain how the FP(1) yaw maneuver operation takes place by demonstrating a 30-degree counterclockwise rotation and then a 30-degree clockwise rotation as the flowing direction of the sea water mass flow changes a 30-degree counterclockwise rotation and then a 30-degree clockwise rotation.

FIG. 3 shows a situation in which the FP centerline (6) is aligned with the direction of the ocean wave water mass flow (17). The windows (5) on Wing A (7) and Wing D (10) are all opened by the push of the ocean wave water mass flow (13). The windows (5) on Wing B (8) and Wing C (9) are all closed by the push of the ocean wave water mass flow (18). Since the water pressure on Wing B (8) is equal to the water pressure on Wing C (9), the FP (1) will be balanced, and the centerline will be aligned with the direction (17) in which the water mass is flowing. The Heavy Anchors (21) prevent the rotation of the System Air/Water Tank (3) and keep it at the position where it is installed.

FIG. 4 shows a situation in which the water mass flowing direction (17) is rotated 30 degrees counterclockwise. The figure shows that the water pressure builds up on Wing B (8) alone, which causes the FP (1) to rotate counterclockwise.

FIG. 5 shows the FP(1) after the 30-degree counterclockwise rotation of the FP (1). It can be seen that the water pressure on Wing B (8) is equal to the water pressure on Wing C (9), which maintains a balanced position. The centerline (6) is aligned with the direction in which the water mass is flowing (17). Water pressures on Wing A (7) and Wing D (10) are negligible.

FIG. 6 shows a situation in which the direction of the water mass flow is rotated 30 degrees clockwise back to the original direction of the water mass flow. No water mass pressures are built on Wings A (7), B (8), and D (10). The water mass pressure on Wing C (9) rotates the FP(1) clockwise.

FIG. 7 shows the FP (1) after the 30-degree clockwise rotation of the FP (1) back to the original position.

FIGS. 8, 9, 10, and 11 show the same process as shown above but this time the flow direction of the water mass rotates 30 degrees clockwise to start with.

FIG. 8 shows a situation in which the water mass flowing direction (17) is rotated 30 degrees clockwise. The figure shows that the water pressure builds up on Wing C (9) alone, which causes the FP (1) to rotate clockwise.

FIG. 9 shows the FP(1) after the 30-degree clockwise rotation. It can be seen that the water pressure on Wing B (8) is equal to the water pressure on Wing C (9), which maintains a balanced position. The centerline (6) is aligned with the direction in which the water mass is flowing (17). Water pressures on Wing A (7) and Wing D (10) are negligible.

FIG. 10 shows a situation in which the direction of the water mass flow is rotated 30 degrees counter clockwise back to the original direction of the water mass flow. No water mass pressures are built on Wings A (7), C (9), and D (10). The water mass pressure on Wing B (8) rotates the FP(1) counter clockwise.

FIG. 11 shows the FP (1) after the 30-degree counter clockwise rotation of the FP (1) back to the original position.

FIG. 12 shows how the Automatic Direction Alignment Subsystem works in the ocean where unlike in a river, water mass moves back and forth.

When the sea water mass flows from the north, water flow pressure of equal strength builds on Wing B (8) and Wing C (9) in FIG. 12. There will be no water pressure on Wing A (7) and Wing D (10) in this case. This balanced water pressure distribution on the Wing B (8) and Wing C (9) causes the FP (1) to be aligned with the direction of the water mass flow (17).

When water mass flows from the south, water flow pressure of equal strength builds on Wing A (7) and Wing D (10). There will be no water pressure on Wing B (8) and Wing C (9). This balanced water pressure distribution on Wing A (7) and Wing D (10) causes the FP (1) to be aligned with the direction of the water mass flow (17).

Therefore, once the centerline is aligned with the direction of the water mass flow, the reverse of the mass flow direction will not change the centerline orientation.

What is claimed is:

1. An Automatic Water-Flowing Directional-Alignment System designed for aligning a floating-platform-center-line-direction with a water-mass-flowing-direction automatically in a river or ocean, comprising: a floating platform, a set of wings, windows on the wings with window frames, a floating-platform-air/water-tank, a system-air/water-tank, yaw maneuver supporting rollers, and a floating-platform center-line, wherein each of the wings has a plurality of windows with window frames, wherein the windows have hinges at a top of the window frame and the windows rotate around the hinges, wherein the windows are allowed to be opened in either a clockwise or counter-clockwise rotation depending on the water-mass-flowing-direction in a river or ocean, wherein the wings are attached-to the floating platform symmetrically with respect to an axial-centerline such that the windows of the wings that encounter the water-mass-flow first are to be opened and let the water-mass-flow pass through while the windows that encounter the water-mass-flow last are designed to be closed and block the water-mass-flow and build up water-mass pressure on these wings, and thus balance the floating platform, wherein the floating platform is installed on a top of the floating-platform-air/water-tank, and the floating-platform-air/water-tank with the floating platform is installed inside the system-air/water-tank, and the floating-platform-air/water-tank is floating in the system-air/water-tank and there is a space between the floating-platform-air/water-tank and the system-air/water-tank, and the space is filled with water, wherein the yaw maneuver supporting rollers are installed between the floating-platform-air/water-tank and the system-air/water-tank for easy yaw maneuver of the floating-platform-air/water-tank.

2. The Automatic Water-Flowing Directional-Alignment System of claim 1, wherein the wings are attached symmetrically with respect to the axial-centerline, when the water-mass flowing direction is not aligned with the direction of the axial-centerline, the water-mass-flow generates a torque that causes the floating platform to rotate until the axial-centerline of the floating platform is aligned with the water-mass flowing direction.

* * * * *